US008147356B2

(12) United States Patent
Campbell et al.

(10) Patent No.: US 8,147,356 B2
(45) **Date of Patent: *Apr. 3, 2012**

(54) BASKETBALL RETURN APPARATUS

(75) Inventors: Douglas Brad Campbell, Loretto, MN (US); Jeffrey Jon Campbell, Lonsdale, MN (US)

(73) Assignee: Airborne Athletics, Inc., Burnsville, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/193,201

(22) Filed: Jul. 28, 2011

(65) Prior Publication Data

US 2011/0281672 A1 Nov. 17, 2011

Related U.S. Application Data

(63) Continuation of application No. 12/384,143, filed on Apr. 1, 2009, now Pat. No. 8,012,046.

(51) Int. Cl.
*A63B 69/00* (2006.01)

(52) U.S. Cl. ..... 473/433

(58) Field of Classification Search ..... 473/431–436, 473/394–397

See application file for complete search history.

(56) References Cited

U.S. PATENT DOCUMENTS

| | | | | | |
|---|---|---|---|---|---|
| 3,814,421 | A * | 6/1974 | Spier, Jr. | ..... | 473/433 |
| 4,869,502 | A * | 9/1989 | Wares | ..... | 473/433 |
| 4,896,882 | A * | 1/1990 | Coleman | ..... | 473/433 |
| 4,913,431 | A * | 4/1990 | Jakobs | ..... | 473/433 |
| 4,936,577 | A * | 6/1990 | Kington et al. | ..... | 473/433 |
| 4,940,231 | A * | 7/1990 | Ehler | ..... | 473/431 |
| 5,016,875 | A * | 5/1991 | Joseph | ..... | 473/433 |
| 5,273,275 | A * | 12/1993 | Wilkerson | ..... | 473/433 |
| 5,368,292 | A * | 11/1994 | Metz | ..... | 473/433 |
| 5,507,483 | A * | 4/1996 | Hektor | ..... | 473/433 |
| 5,540,428 | A * | 7/1996 | Joseph | ..... | 473/433 |
| 5,681,230 | A * | 10/1997 | Krings | ..... | 473/433 |
| 5,746,668 | A * | 5/1998 | Ochs | ..... | 473/433 |
| 6,056,652 | A * | 5/2000 | Lees et al. | ..... | 473/433 |
| 6,224,503 | B1 * | 5/2001 | Joseph | ..... | 473/422 |
| 6,267,696 | B1 * | 7/2001 | Mabe et al. | ..... | 473/433 |
| 6,458,049 | B2 * | 10/2002 | Bush | ..... | 473/433 |
| 6,752,728 | B1 * | 6/2004 | Tien | ..... | 473/433 |
| 2007/0037638 | A1 * | 2/2007 | Rumfola | ..... | 473/433 |
| 2007/0042842 | A1 * | 2/2007 | Thomas | ..... | 473/433 |
| 2010/0113189 | A1 * | 5/2010 | Blair | ..... | 473/433 |

* cited by examiner

*Primary Examiner* — Mark Graham
(74) *Attorney, Agent, or Firm* — Kinney & Lange, P.A.

(57) ABSTRACT

A basketball return apparatus includes an L-shaped frame, a net, and a ball return mechanism. The frame has a back portion and a base portion. The back portion has an upper end adapted to mount on a rim support bracket of the basketball hoop and center and stabilize the frame with respect to the basketball hoop. The back portion has side members that connect to the upper end and extend generally vertically downward to connect to the base portion. The base portion defines an orifice through which shot basketballs can descend. The net is attached to the frame to form open funnel shaped enclosure with an open top end and an open bottom end. The enclosure directs basketballs downward therethrough to the base portion. The ball return mechanism is mounted to the frame below the orifice and net to direct the basketballs back to the shooter.

19 Claims, 13 Drawing Sheets

BASKETBALL RETURN APPARATUS

CROSS-REFERENCE TO RELATED APPLICATION

This application is a continuation of U.S. patent application Ser. No. 12/384,143 filed Apr. 1, 2009 for BASKETBALL RETURN APPARATUS WITH MOUNTING STAND which claims the benefit of Provisional Application No. 61/190,418 filed on Aug. 28, 2008 for BASKETBALL RETURN APPARATUS WITH MOUNTING STAND, the entire content of which is expressly incorporated by reference.

BACKGROUND

The present invention relates to a basketball return apparatus, and more particularly to a basketball return apparatus that is easily mounted on a basketball hoop or goal to capture made and missed basketballs.

"Practice makes perfect," so the adage goes. The game of basketball is not exempt from this age old adage. Practice is known to improve the player's basketball skills. Taking numerous shots at a basketball hoop is a key element of basketball practice as it develops the player's shooting ability and technique. However, unless a second player is present to rebound for the first player (the shooter), the first player must rebound his or her own shots. This rebounding process wastes time that could otherwise be used by the player to practice skills including shooting.

A wide variety of basketball return devices have been conceived to reduce the time spent rebounding basketball shots. These devices generally include netting and a frame. The frame is secured to the backboard, mounted to the stanchion, or placed on the basketball court below the hoop. The netting is stretched between the frame to surround the basketball rim and capture basketballs from made and missed shots. A structure such as a ramp is disposed beneath the netting to direct the shot basketball(s) to a collection point or to the shooter.

Prior art ball return devices suffer from several disadvantages. These devices tend to be large and cumbersome to install or move from one location to another. Many backboard or stanchion mounted devices require installation personnel to climb a ladder above the height of the rim to loosen or tighten multiple fasteners which secure the device to the hoop. Ball return devices that are secured to the backboard or stanchion may not accommodate both fan shaped and square backboard designs.

Ball return devices that extend upward from a position on the playing court obstruct a good deal of the court. In instances where the court is a garage driveway, the use of the device will therefore negatively affect ingress and egress of automobiles to and from the garage.

SUMMARY

A basketball return apparatus includes a frame, netting, and a ball return mechanism. The frame is adapted to mount on a rim support bracket of a basketball hoop and defines an orifice through which shot basketballs can descend. The netting is collapsible and extensible and is attached to the frame to form open funnel shaped enclosure that directs basketballs downward therethrough. The ball return mechanism is mounted to the frame below the orifice and netting to direct the basketballs back to the shooter.

DETAILED DESCRIPTION

Figure 1A:
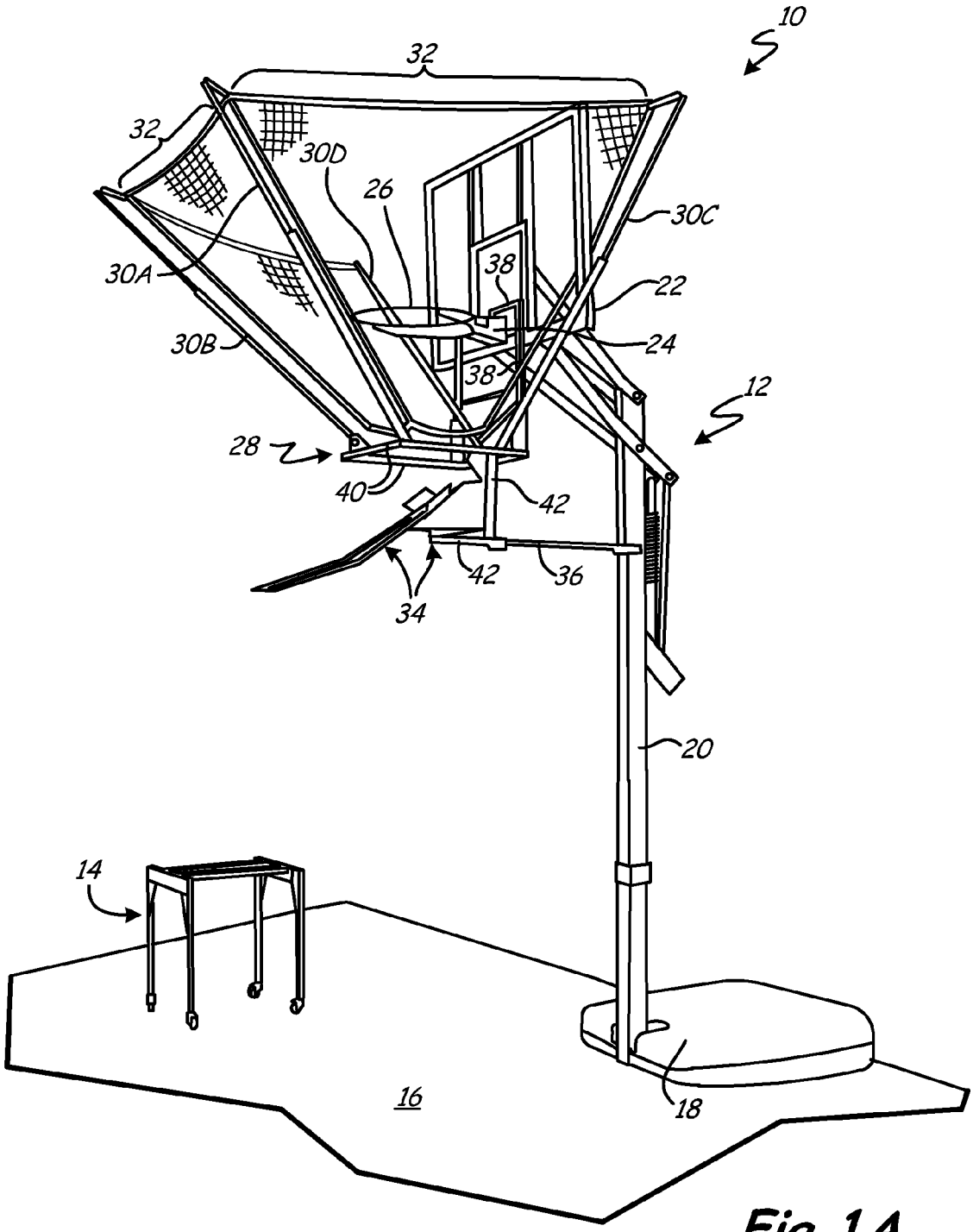
FIG. 1A is a view of an embodiment of a basketball return apparatus mounted on a basketball hoop with a drop stand positioned on a basketball court below the basketball hoop.
Figure 1B:
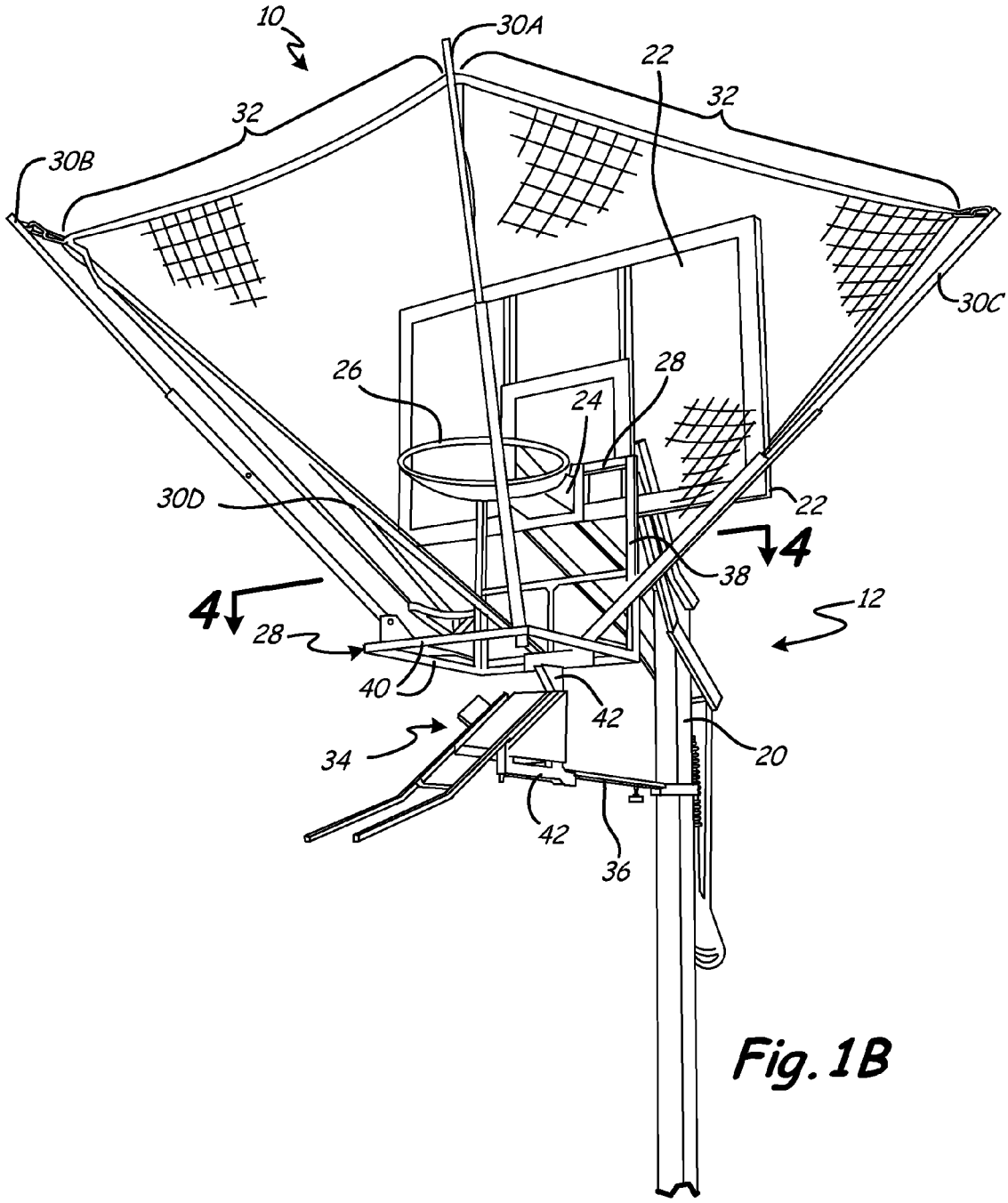
FIG. 1B is a view of the basketball return apparatus mounted on the basketball hoop from a different perspective than the view of FIG. 1A.

FIG. 1A is a view of one embodiment of a basketball return apparatus 10 mounted on a basketball hoop 12 with a drop stand 14 positioned on a basketball court 16 below the basketball hoop 12. FIG. 1B is a view of the basketball return apparatus 10 mounted on the basketball hoop 12 from a different perspective than the view of FIG. 1A. The basketball hoop 12 includes a base 18, a stanchion or pole 20, a backboard 22, a rim support bracket 24, and a rim 26. The basketball return apparatus 10 includes a frame 28, arms 30A-30D, netting 32, a ball return mechanism 34, and a support arm 36. The frame 28 includes a back portion 38, a base portion 40, and a foot portion 42. The arms 30A-30D include front arms 30A, 30B and rear arms 30C, 30D.

In FIG. 1A, the basketball return apparatus 10 is mounted on the basketball hoop 12 which extends upward from the basketball court 16. The four legged drop stand 14 is illustrated positioned on the court 16 after having been detached from the basketball return apparatus 10. The base 18 of the basketball hoop 12 is adapted to stabilize the basketball hoop 12 in an upright position on the court 16. The base 18 connects to the stanchion 20 (in this embodiment a single generally vertically disposed pole). The stanchion 20 connects to the backside of the backboard 22. In the embodiment shown, the backboard 22 is generally square and has the rim support bracket 24 secured to a frontside thereof. More particularly, the rim support bracket 24 cantilevers outward from a lower middle position on the frontside of the backboard 22. The rim support bracket 24 extends outward to connect to the back portion of the circular rim 26.

As illustrated in FIGS. 1A and 1B, the basketball return apparatus 10 has a frame 28 configured to extend over the rim support bracket 24 to mount the basketball return apparatus 10 thereon. A lower portion of the frame 28 is disposed below the rim 26 and provides a base to which the arms 30A-30D are connected. The arms 30A-30D connect to the frame 28 and extend therefrom to a selective height above the rim 26 of the basketball hoop 12. The netting 32 is collapsible and extensible and when extended is attached to the arms 30A-30D to form an upwardly and downwardly opened funnel shaped enclosure. More particularly, the netting 32 extends between the front arms 30A, 30B and from the front arms 30A, 30B to the rear arms 30C, 30D. The smaller downwardly disposed opening of the funnel shaped enclosure terminates adjacent the lower portion of the frame 28 below the rim 26. The ball return mechanism 34 is mounted to a lower most portion of the frame 28 generally below the rim 26. An extendible support arm 36 connects to the frame 28 and is adapted to engage the stanchion 20 of the basketball hoop 12 to increase the stability of the apparatus 10 when the apparatus 10 is mounted on the basketball hoop 12. In one embodiment, the support arm 36 can be bent in an L-shape or otherwise rotated to engage the stanchion 20 adjacent to the location where the stanchion 20 connects with the backboard 22.

More particularly, the open frame 28 has a rectangular shaped back portion 38 which is sized to slip over the rim 26 and is adapted to mount on the rim support bracket 24. In the mounted position, the back portion 38 extends generally vertically downward to either side of the rim support bracket 24 to connect to the base portion 40 of the frame 28 below the rim 26. The foot portion 42 connects to the base portion 40 and extends therebelow to connect with the ball return mechanism 34 and the support arm 36. In the embodiment shown, the base portion 40 of the frame 28 is generally square shaped and connects with the arms 30A-30D. The rear arms 30C, 30D and front arms 30A, 30B are disposed at an angle from the vertical so as to give the netting 32 the funnel shape illustrated. The smaller downwardly disposed opening of the funnel shaped netting 32 can be connected to the base portion 40 by a draw string or cord to allow the netting 32 to be selectively drawn tighter against the base portion 40 of the frame 28 and the arms 30A-30D.

The design of the basketball return apparatus 10 allows it to be mounted on the basketball hoop 12 via only the rim support bracket 24. The basketball return apparatus 10 can be mounted to virtually any basketball hoop 12 because the rim support bracket 24 extends a standard distance from the backboard 22 (a minimum of 6 inches (15.24 cm) according high school, NCAA, and NBA regulation) before connecting to the rim 26. In one embodiment, the collapsibly-extensible netting 32 attached to the arms 30A-30D extends from adjacent the base portion 40 of the frame 28 to a height of between about 15 to 21 inches (between about 38 to about 54 cm) above the rim 26 and extends outward from adjacent the base portion 40 of the frame 28 to a distance of between about 40 to 60 inches (between about 102 to about 153 cm) from a centerpoint of the rim 26. The disposition of the netting 32 in this range encourages the shooter to put an ideal arc on their jump shot, thus increasing the shooter's chances of developing a "shooter's touch" which increases the likelihood that the basketball will go in the basket if the ball makes contact with the rim 26.

In the mounted position, the basketball return apparatus 10 collects and returns basketballs shot at the basketball hoop 12 to the basketball shooter. More particularly, when basketballs shot by the shooter clear the top portion of the netting 32, the balls enter the funnel shaped enclosure formed by the netting 32. If the shooter's shoot is errant, the basketball will generally carom off the rim 26 or backboard 22 and strike an interior portion of the funnel shaped netting 32. Gravity and the shape of the netting 32 then guides the ball downward through the open framed base portion 40 to the ball return mechanism 34 which directs the basketball back to the shooter. Shot basketballs that go through the rim 26 (i.e. are made) may also contact the interior portion of the funnel shaped netting 32 and hence are guided downward thereby to the ball return mechanism 34. Therefore, like missed shots, made shots will pass through the open framed base portion 40 to the ball return mechanism 34 which directs the basketball back to the shooter. The support arm 36 engages the stanchion 20 to increase the stability of the basketball return apparatus 10. The support arm 36 increases stability by reducing the instances of side-to-side or lateral swaying of the apparatus 10 due to errant basketballs striking the netting 32 or frame 28.

As will be discussed subsequently, the mounting and dismounting of the basketball return apparatus 10 can be accomplished by the drop stand 14 which is adapted to receive the base portion 40 of the frame 28 and is selectively attachable and detachable therefrom. The stand 14 allows the basketball return apparatus 10 to be mounted on the support bracket 24 and dismounted therefrom from a set up position on the basketball court 16 below the rim 26. Thus, the basketball return apparatus 10 can be easily and quickly mounted and dismounted by the user without having to tighten or loosen fasteners. Similarly, the design of the apparatus 10 allows the apparatus 10 to be mounted without the labor or time intensive installation of brackets on the backboard 22. The apparatus 10 can be operatively mounted to embodiments of the basketball hoop 12 which utilize any type of backboard 22 design including both square and fan-shaped backboards 22. The basketball return apparatus 10 can be constructed utilizing a polymeric material or with polymeric and metallic materials so as to be sufficiently small and lightweight such that mounting and dismounting of the apparatus 10 can be accomplished by a single individual. Once mounted, the basketball return apparatus 10 is designed to leave a vertical distance between the lower end of the ball return mechanism 34 and the court 16 which frees the area below the apparatus 10 for use by the player during practice. The vertical distance between the lower end of the ball return mechanism 34 and the court 16 also allows for the passage of an automobile should it be driven under the basketball hoop 12 to be parked in a garage.

Figure 2:
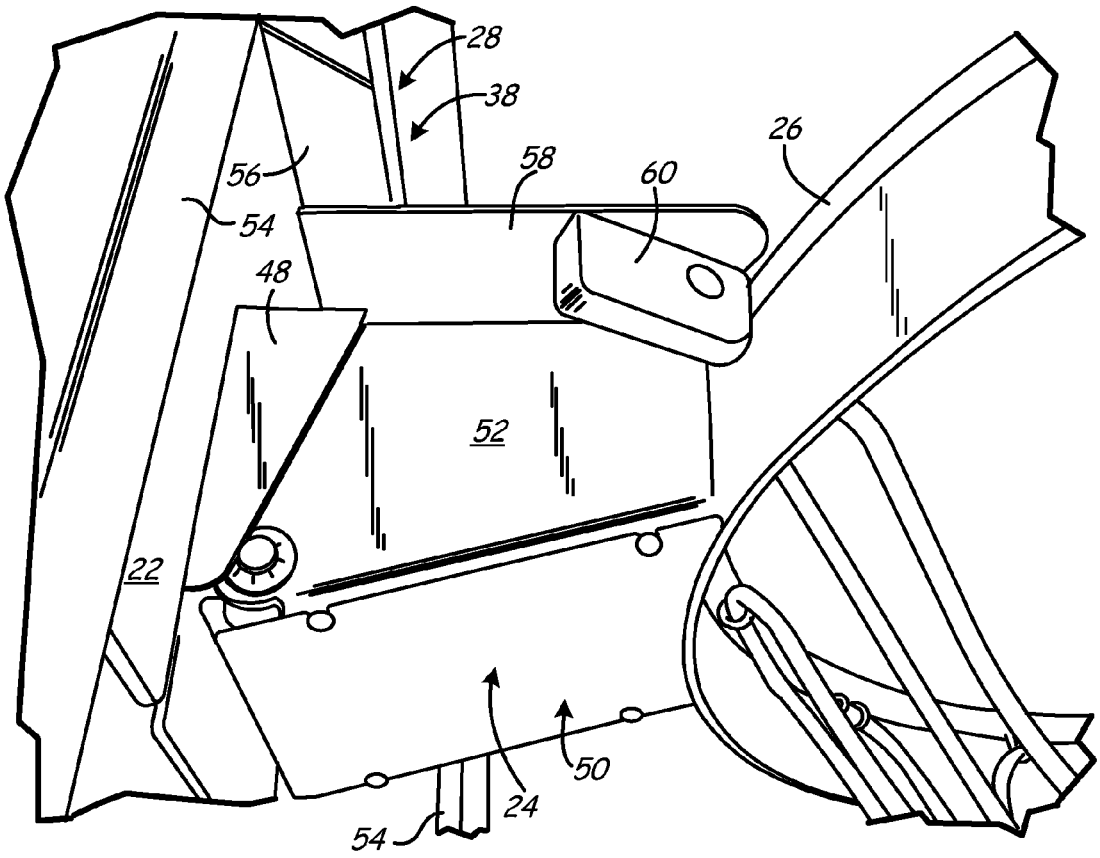
FIG. 2 is a view of a frame of the basketball return apparatus in the mounted position on a rim support bracket.

FIG. 2 is a view of the back portion 38 of the frame 28 of the basketball return apparatus 10 in the mounted position on the rim support bracket 24. The rim support bracket 24 includes a receiving bracket 48, main body 50, and side surfaces 52. The back portion 38 includes side members 54, a top cross member 56, and a mounting plate 58. The mounting plate 58 includes mounting pads 60.

In the mounted position illustrated, the back portion 38 of the frame 28 is slipped over the rim 26 and then lowered to rest on the rim support bracket 24. The embodiment of the rim support bracket 24 shown is a breakaway type of support structure which houses an internal return spring (not shown). The receiving bracket 48 is secured to the backboard 22. The return spring (not shown) is connected between the main body 50 and the receiving bracket 48 to allow the main body 50 to return to a seated position within the receiving bracket 48 after the rim 26 has been released by the player (who may have grabbed the rim 26 in a successful or unsuccessful attempt to dunk the basketball therethrough). The return of the main body 50 to the seated position within the receiving bracket 48 optimally returns the top surfaces of the rim support bracket 24 and rim 26 to generally horizontal positions with respect to the basketball court 16 (FIG. 1A). The side surfaces 52 extend from the top surface of the rim support bracket 24 to a bottom surface thereof to enclose the internal return spring (not shown).

The side members 54 of the frame 28 extend generally vertically upward from the base portion 40 (FIGS. 1A and 1B). The side members 54 extend generally parallel with each other and with the side surfaces 52 of the rim support bracket 24 adjacent the backboard 22 when the apparatus 10 is mounted on the rim support bracket 24. The side members 54 are interconnected by the top cross member 56 which extends over the rim support bracket 24. The generally flat mounting plate 58 cantilevers from a bottom surface of the top cross member 56 and interfaces with and seats on the top surface of the rim support bracket 24. In one embodiment, the mounting plate 58 may have a device which assists it in coupling to the rim support bracket 24. Coupling devices could include, for example, magnets attached thereto which help to magnetically couple the mounting plate 58 to the rim support bracket 24. Alternatively, the coupling device can include suction cups, Velcro®, or the like. The mounting plate 58 can be sized so as not to extend over the goal portion of the rim 26 and interfere with the shooter's shots. The mounting pads 60 extend downward from a portion of the bottom surface of the mounting plate 58. The mounting pads 60 extend to either side of the side surfaces 52 of the rim support bracket 24 when the mounting plate 58 is disposed thereon. The mounting pads 60 are disposed to either side of the rim support bracket 24 adjacent the two side surfaces 52. Each of the mounting pads 60 are disposed at an angle to the side surface 52 with which it interfaces such that the rear portion of the mounting pad 52 is disposed further away from the interfacing side surface 52 than the front portion. Thus, the front portion of the each mounting pad 60 is disposed closer to the side surface 52 with which it interfaces. The disposition of the mounting pads 60 allows the front surface of each mounting pad 60 to be angled to contact the back edge of the rim 26.

When the basketball return apparatus 10 is mounted on the rim support bracket 24 the components of the apparatus 10 including the frame 28 (the back 38, base 40, and foot 42 portions), arms 30A-30D, and ball return mechanism 34, can be arranged to dispose the center of mass of the apparatus 10 nearly vertically below the mounting plate 58 (FIG. 1A). This arrangement minimizes forward tilting of the apparatus 10. The result of such an arrangement is that the base portion 40 of the frame 28 is kept in a generally horizontal position with respect to the basketball court 16 (FIG. 1A). Forward tilting of the apparatus 10 can also be minimized by the mounting pads 60 which contact the back of the rim 26 to help eliminate forward tilt. If coupling devices such as magnets are used to couple the mounting plate 58 to the rim support bracket 24, apparatus 10 tilt can be decreased and the mounted stability of the apparatus 10 can be increased. The disposition of the mounting pads 60 allows the front surface of each of the mounting pads 60 to contact and pinch the back portion of the rim 26 during instances of side-to-side or lateral swaying of the apparatus 10 due to errant basketballs striking the netting 32 or frame 28. Thus, the contacting and pinching of the front surface of each of the mounting pads 60 with the rim 26 increases the stability of the basketball return apparatus 10.

Figure 3:
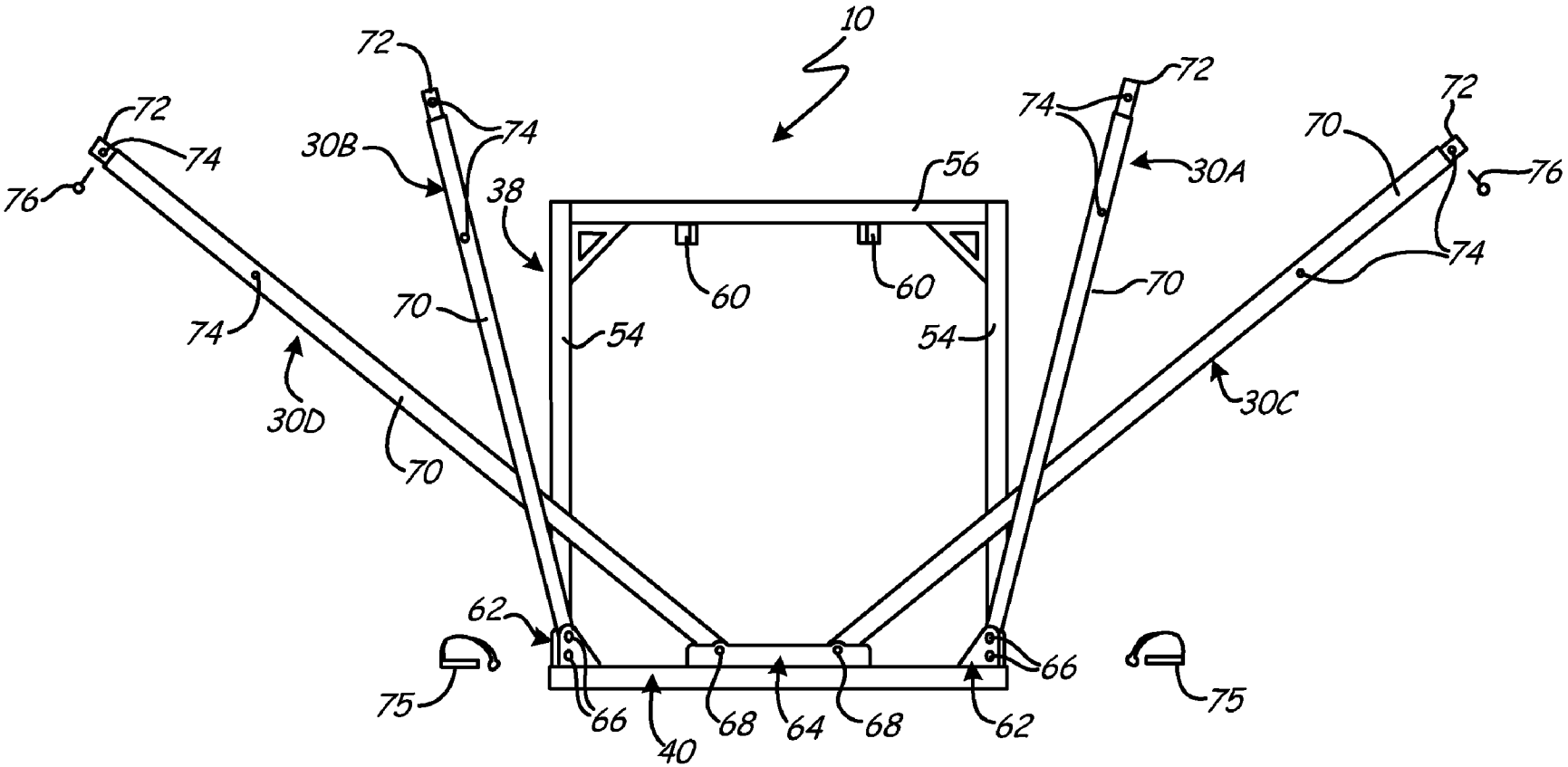
FIG. 3 is a front view of the basketball return apparatus with the netting removed to better illustrate the frame and arms of the apparatus.

FIG. 3 is a front view of the basketball return apparatus 10 with the netting 32 removed to better illustrate the frame 28 and arms 30A-30D of the apparatus 10. The frame 28 includes front arm brackets 62 and a rear bracket 64. The front arm brackets 62 include apertures 66. The rear bracket 64 includes apertures 68. The arms 30A-30D include an outer portion 70 and an inner portion 72. Both the outer arm 70 and the inner arm 72 include apertures 74. The apparatus 10 includes fasteners 75.

The front arm brackets 62 and the rear bracket 64 connect to the base portion 40 of the frame 28. The rear bracket 64 is disposed behind the back portion 38 of the frame 28. The front arm brackets 62 have apertures 66 which receive fasteners 75 that extend through the front brackets 62 and front arms 30A, 30B. The fasteners 75 allow the front arms 30A, 30B to pivot with respect to the front arm brackets 62. In one embodiment, the front arms 30A, 30B can be pivoted on fasteners 75 from the operative mounted position illustrated to a storage position generally vertically above the base portion 40 of the frame 28. The front arms 30A, 30B can be secured in either position by a second set of fasteners 75 (in one embodiment a clevis pin) which pass through a second higher disposed set of apertures 66 in the front arm brackets 62. Similar to the front arm brackets 62, the rear bracket 64 has apertures 68 which receive fasteners 75 that extend through the rear bracket 64 and rear arms 30C, 30D. The fasteners 75 allow the rear arms 30C, 30D to pivot with respect to the rear bracket 64. In one embodiment, the rear arms 30C, 30D can be pivoted on fasteners 75 from the operative mounted position illustrated to a storage position generally vertically above the base portion 40 of the frame 28.

In one embodiment, the arms 30A-30D are length adjustable. To accomplish extension and retraction of the arms 30A-30D the outer portion 70 and inner portion 72 are telescopically arranged. The outer portion 70 that pivotally couples with the brackets 62 and 64. The inner portion 72 is telescopically disposed within the outer portion so that it can be drawn within the outer portion 70 to a desired length. Fastener(s) 75 such as a push pin(s) can be inserted through apertures 74 in the inner and outer portion 70 and 72 to affix the portions 70 and 72 together at that desired length. The top end part of the inner portion 70 may include apertures 74 that receive a fastener (not shown) which secures the netting 32 to the arms 30A-30D (FIGS. 1A and 1B).

Figure 4:
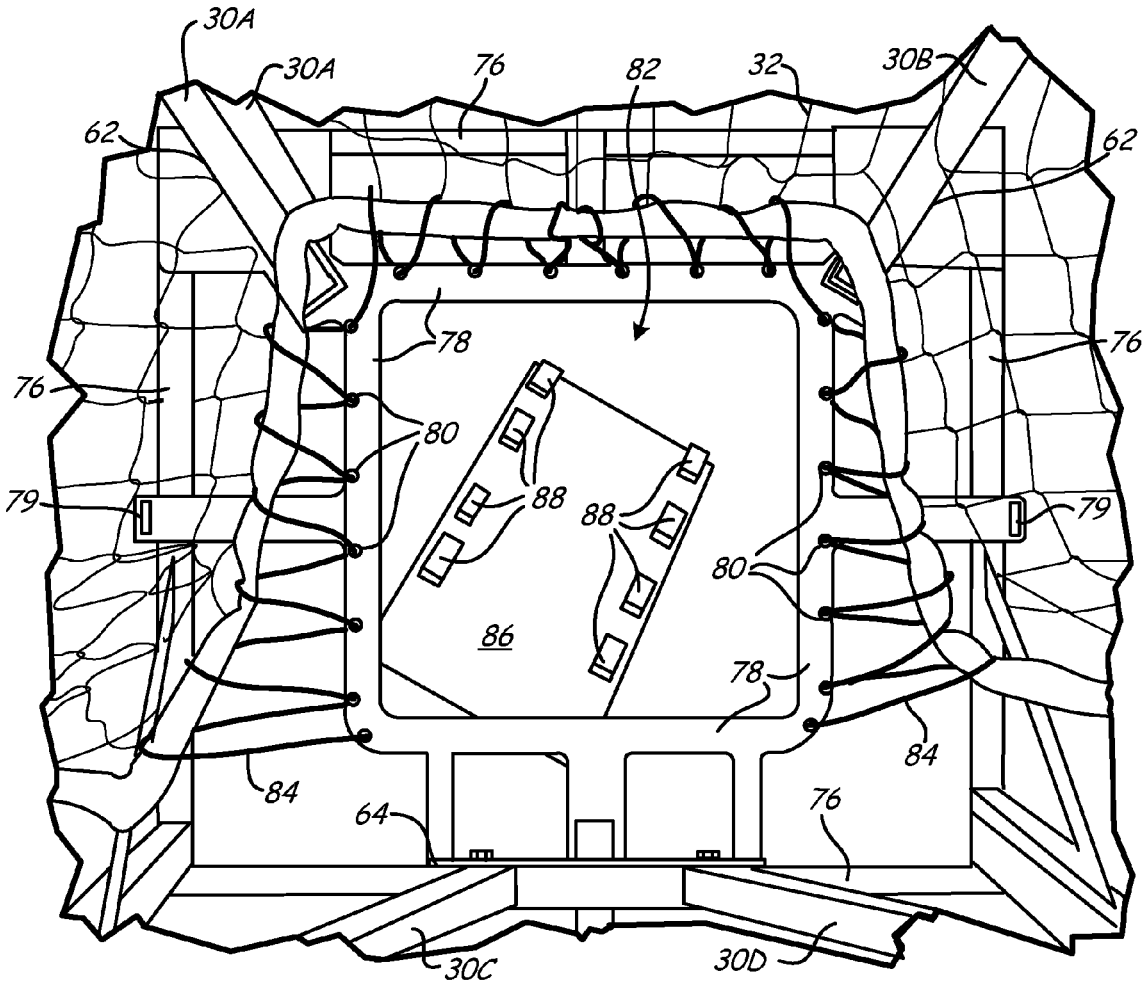
FIG. 4 is a top view of a base portion of the frame and a ball return mechanism of the basketball return apparatus taken along line 4-4 of FIG. 1B.

FIG. 4 is a top view of a base portion 40 of the frame 28 and the ball return mechanism 34 of the basketball return apparatus 10 taken along line 4-4 of FIG. 1B. As illustrated, the ball return mechanism 34 has a ramp portion detached therefrom to show additional features. The base portion 40 includes an outer frame 76 and an inner frame 78. The outer frame 76 includes catches 79. The inner frame 78 has apertures 80 and forms an orifice 82. The netting 32 includes cord 84. The ball return mechanism 34 includes a body 86 and tabs 88.

The square shaped outer frame 76 of the base portion 40 connects to the arms 30A-30D and the back portion 38. The square shaped inner frame 78 is disposed within the outer frame 76 and connects thereto via a plurality of members. The outer frame includes U-shaped catches 79 that project away from the inner frame 78 and are adapted to receive a portion of the drop stand 14 therein (FIG. 1A). The inner frame 78 has apertures 80 along the outer edge thereof. The apertures 80 receive the cord 84 which enwraps the lower portion of the netting 32. The inner frame 78 defines the orifice 82 which is disposed generally above the ball return mechanism 34. Below the orifice 82 the body 86 of the ball return mechanism 34 pivotally couples to the foot portion 42 of the frame 28. In one embodiment, the body 86 houses a motor which rotatably drives the ball return mechanism 34 reciprocatingly from a first adjustable limit to a second adjustable limit. In one embodiment, the first and second adjustable limits are determined by set screws which when contacted switch the motor to move reciprocally back in the direction from which the ball return mechanism 34 had come. Alternatively, the ball return mechanism 34 may be manually rotated by the shooter to return shot basketballs to a particular location on the court 16 (e.g. the baseline or the top of the key). The tabs 88 project from the main body 86 and form lips which receive the ramp (not shown) thereunder. Thus, the ramp (not shown) is removable from under tabs 88 when the ball return apparatus 10 is in the set up, storage, or mounted positions.

In one embodiment, the elastic cord 84 allows the netting 32 to be selectively drawn tighter against the frame 28 and the arms 30A-30D. The orifice 82 is sized to allow shot basketballs to descend therethrough to the ball return mechanism 34. The ball return mechanism 34 is disposed below the orifice 82 to receive the basketballs and then direct them back to the shooter.

Figure 5A:
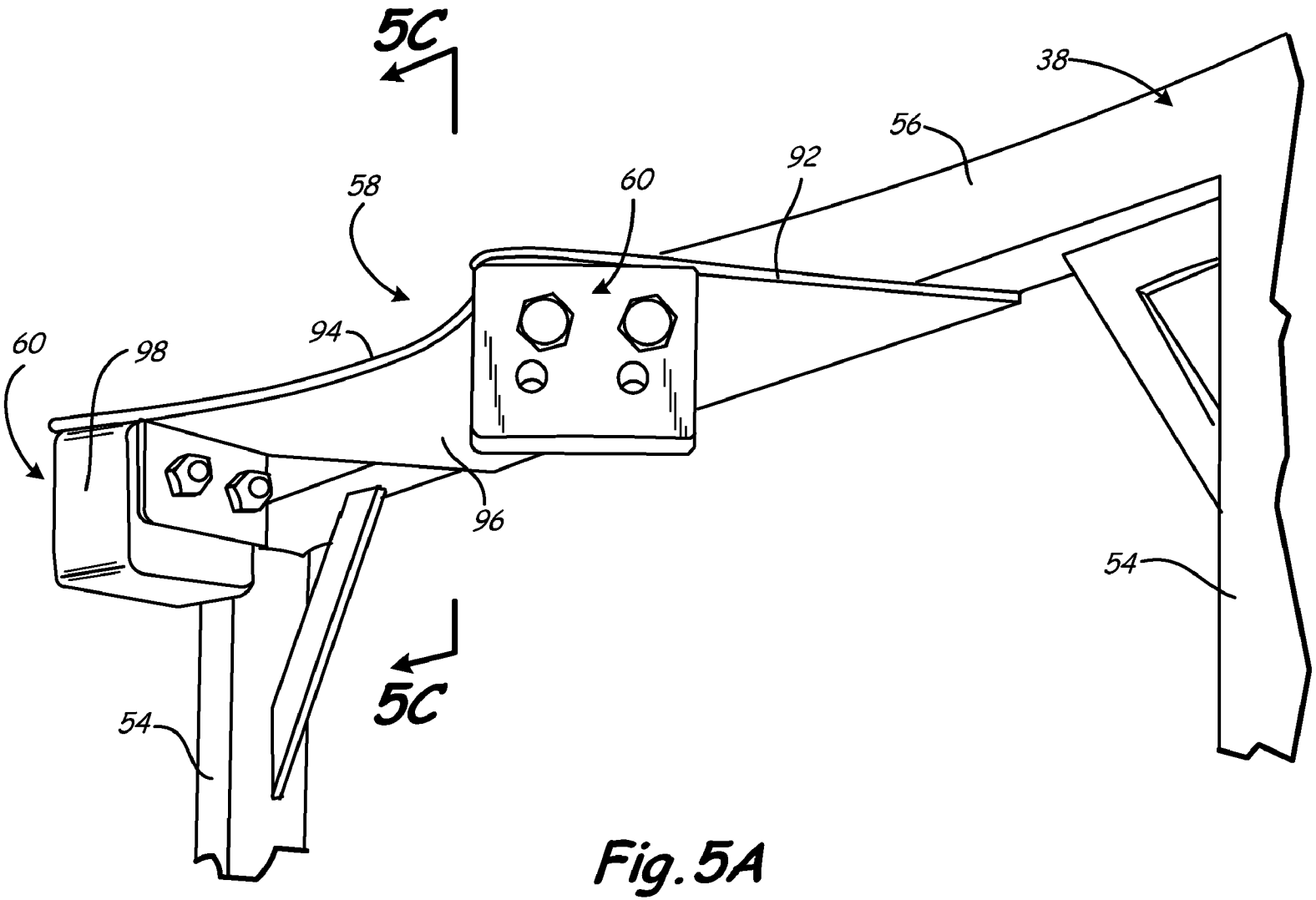
FIG. 5A is a perspective view of a mounting bracket attached to a back portion of the frame of the basketball return apparatus.
Figure 5B:
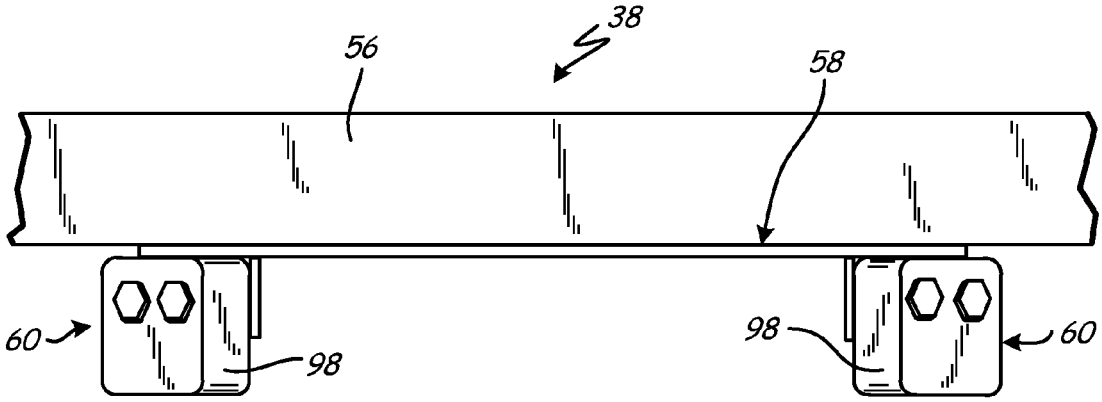
FIG. 5B is a front view of the mounting bracket from FIG. 5A.
Figure 5C:
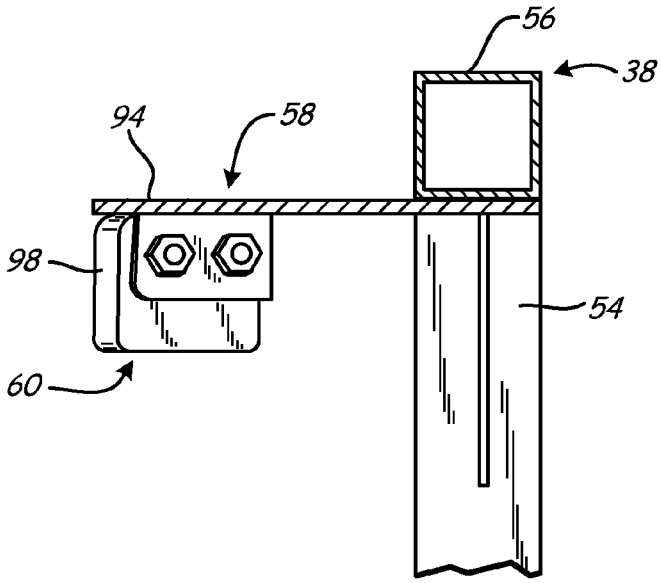
FIG. 5C is a sectional view of the mounting bracket taken along line C-C of FIG. 5A.

FIGS. 5A-5C illustrate the mounting plate 58 and mount pads 60. The mounting plate 58 includes side surfaces 92, a top surface 94, and a bottom surface 96. The mounting pads 60 include front surfaces 98.

The side surfaces 92 connect the top surface 94 of the mounting plate 58 to the bottom surface 96. The mounting pads 60 extend downward from the bottom surface 96 of the mounting plate 58 adjacent the side surfaces 92. Thus, one of the mounting pads 60 is disposed adjacent one of the two side surfaces 92. Each of the mounting pads 60 are disposed at an angle A to the side surface 92 adjacent it such that the rear portion of the mounting pad 52 is disposed further away from the adjacent side surface 92 than the front portion. The disposition of the mounting pads 60 allows the front surface 98 of each mounting pad 60 to contact the back edge of the rim 26 (FIG. 2).

The front surface 98 of each of the mounting pads 60 contacts the back portion of the rim 26 to help eliminate any forward tilting of the basketball return apparatus 10. The disposition of the mounting pads 60 allows the mounting pads 60 to contact and pinch the back portion of the rim 26 during instances of small side-to-side or lateral swaying of the apparatus 10 due to errant basketballs striking the netting 32 or frame 28. Thus, the contacting and pinching of the mounting pads 60 with the rim 26 increases the stability of the basketball return apparatus 10.

Figure 6A:
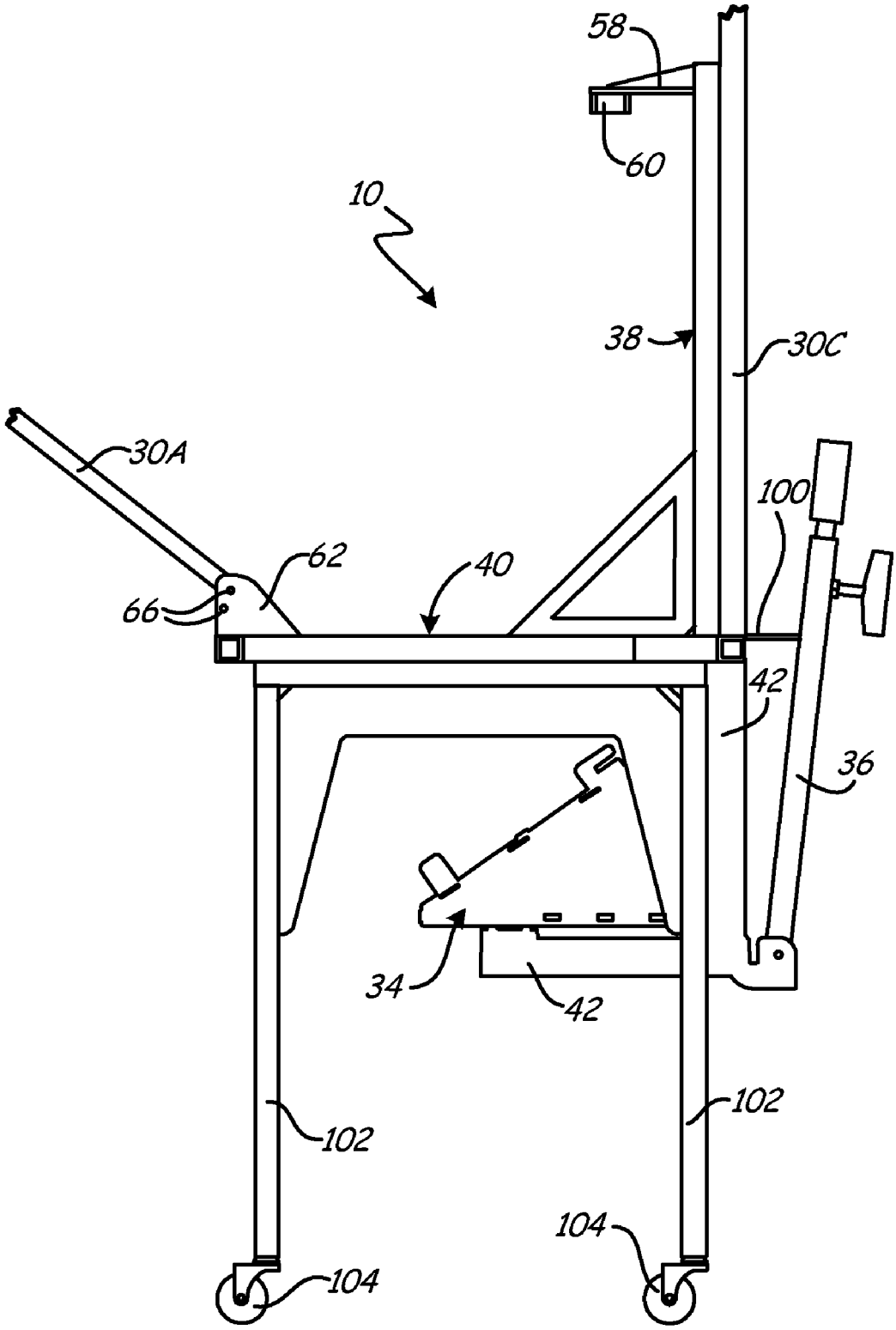
FIG. 6A is a view of the basketball return apparatus in a set up position mounted on the drop stand.

FIG. 6A is a view of the basketball return apparatus 10 in the set up position mounted on the drop stand 14 with arms 30A-30D only partially illustrated. The apparatus 10 includes a clasp 100. The drop stand 14 includes legs 102 and wheels 104.

In the set up position, the base portion 40 of the frame 28 rests upon the top of the drop stand 14. The foot portion 42 of the frame 28 extends downward to dispose the ball return mechanism 34 (shown without the ramp attached) between the legs 102 of the drop stand 14. The legs 102 have wheels 104 are there bottom ends. The clasp 100 connects to the base portion 40 of the frame 28 and can be rotated to engage the support arm 36 to keep the support arm 36 in an upright position out of interference with the wheels 104.

The wheels 104 allow the drop stand 14 and basketball return apparatus 10 to be easily rolled by the user from a storage location to the set up position below the basketball hoop 12 on the court 16.

Figure 6B:
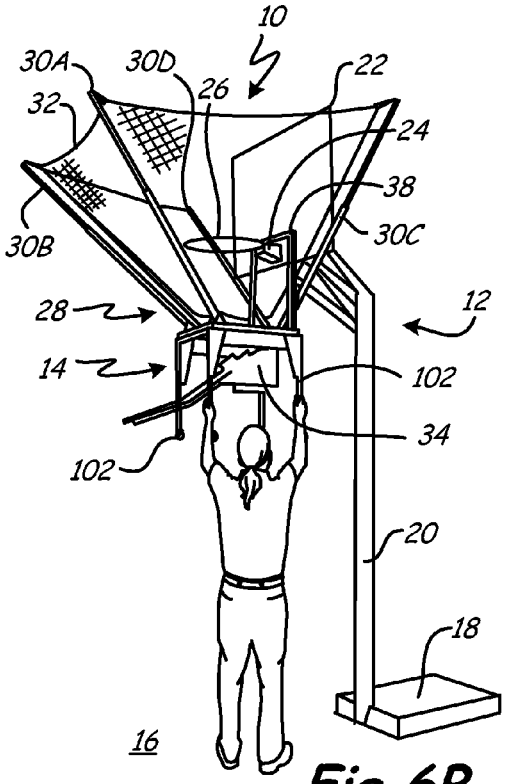
FIG. 6B is a view of the basketball return apparatus being lifted on the drop stand from the set up position below the basketball hoop to the mounted position on the rim support bracket of the basketball hoop.

FIG. 6B is a view of the basketball return apparatus 10 being lifted on the drop stand 14 from the set up position below the basketball hoop 12 to the mounted position on the rim support bracket 24 of the basketball hoop 12.

To begin the mounting process the user (or users) rolls the drop stand 14 with the basketball return apparatus 10 mounted thereon from a storage position to a position on the basketball court 16 adjacent the basketball hoop 12. If in the storage position the arms 30A-30D had been pivoted generally above the orifice 82 defined by the frame 28, the user(s) must fold out the arms 30A-30D to an operative position thereby extending the netting 32. The user(s) also may unlatch the support arm 36 from the frame 28 so that the support arm 36 can operatively stabilize the basketball return apparatus 10 when it is mounted on the rim support bracket 24. To mount the basketball return apparatus 10 on the rim support bracket 24 the user grasps a lower portion of the drop stand 14 (such as the legs 102) and lifts the stand 14 and apparatus 10 generally upward such that the back portion 38 of the frame 28 slips over the rim 26. The apparatus 10 and drop stand 14 are then lowered so that the mounting plate 58 abuts the rim support bracket 24 and the mounting pads 60 abutting the back of the rim 26. To dismount the apparatus 10 from the mounted position on the rim support bracket 24 the user(s) pushes the stand 14 generally upward so that the mounting pads 60 clear the rim support bracket 24 and the rim 26, the apparatus 10 is then drawn outward around the rim 26 until the back portion 38 and support arm 36 clear the rim 26. The user(s) then lowers the basketball return apparatus 10 and stand 14 down to a location on the court 16.

The stand 14 allows the basketball return apparatus 10 to be mounted on the support bracket 24 and dismounted therefrom from the set up position on the basketball court 16 below the rim 26. Because of the drop stand 14, the basketball return apparatus 10 can be easily mounted and dismounted by the user(s) without having to tighten or loosen fasteners. Similarly, the design of the apparatus 10 allows the apparatus 10 to be mounted without the labor or time intensive installation of brackets the backboard 22. In one embodiment, the basketball return apparatus 10 can be constructed of lightweight polymeric material or polymeric and metallic materials such that mounting and dismounting of the apparatus 10 can be done by a single individual.

Figure 6C:
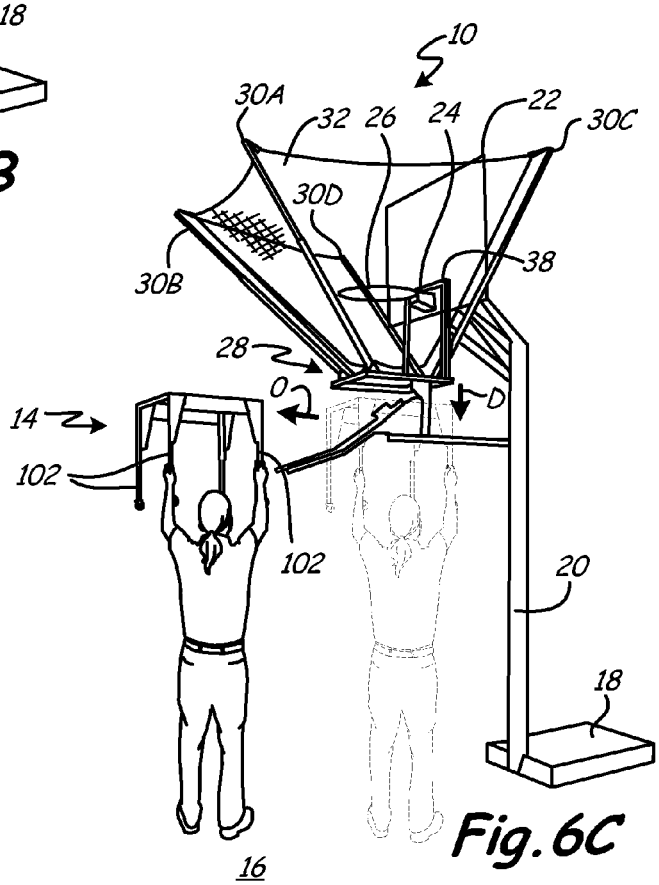
FIG. 6C is a view of the drop stand being detached from the basketball return apparatus which is mounted on the rim support bracket of the basketball hoop.

FIG. 6C is a view of the drop stand 14 being detached from the basketball return apparatus 10 which is mounted on the rim support bracket 24 of the basketball hoop 12.

FIG. 6C depicts a sequence which allows the drop stand 14 to be detached from the basketball return apparatus 10. The detaching of the drop stand 14 allows the apparatus 10 to operatively return made or missed basketballs back to the shooter. To detach the drop stand 14 the user(s) first mounts the apparatus on the support bracket 24 as depicted in FIG. 6B and described above. The user(s) then pulls generally vertically downward (indicated as arrow D) on the drop stand 14. The downward force on the drop stand 14 detaches the drop stand 14 from the apparatus 10. The user(s) than moves the drop stand 14 outward (indicated as arrow O) from the apparatus 10 making sure that the legs 102 of the drop stand 14 clear the ramp of the ball return mechanism 34. The above described process is revered to reattach the drop stand 14 to the basketball return apparatus 10. The support arm 36 can be extended to contact the stanchion 20 at anytime after mounting the basketball return apparatus 10; this includes times prior to or after removal of the drop stand 14 from the apparatus 10.

Figure 7:
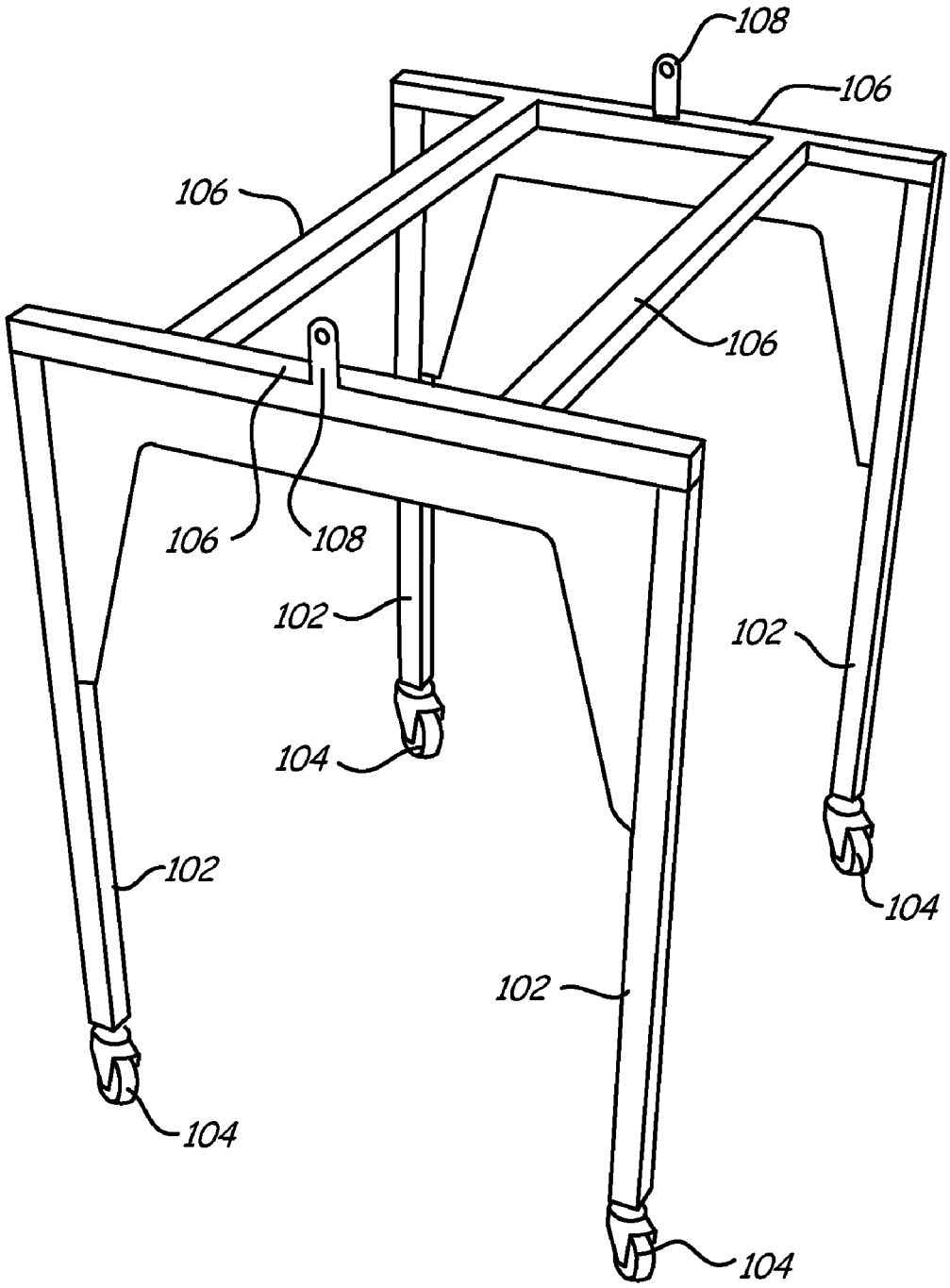
FIG. 7 is a view of the drop stand.

FIG. 7 is a view of the drop stand 14. In addition to the legs 102 and wheels 104, the drop stand 14 includes cross bracing 106 and tabs 108.

The cross bracing 106 extends between the legs 102 of the stand to form a generally flat top surface on which the basketball return apparatus 10 can be mounted. The tabs 108 are disposed on the edge of the cross bracing 106 and are received in the U-shaped catches 79 on the base portion 40 of the frame 28. Once received in the catches 79, the tabs 108 contact and exert opposing pinching force on the outer frame 76 via the catches 79. The coupling of the tabs 108 with the catches 79 and the pinching force that results therefrom provides sufficient resistive force to stabilize the basketball return apparatus 10 on the drop stand 14 while being raised by the user(s) to the mounted position on the rim support bracket 24. However, the pinching force the tabs 108 exert on the frame 28 can be overcome by the generally vertically downward pull of the user(s) on the drop stand 14 which removes the tabs 108 from the catches 79.

Figure 8A:
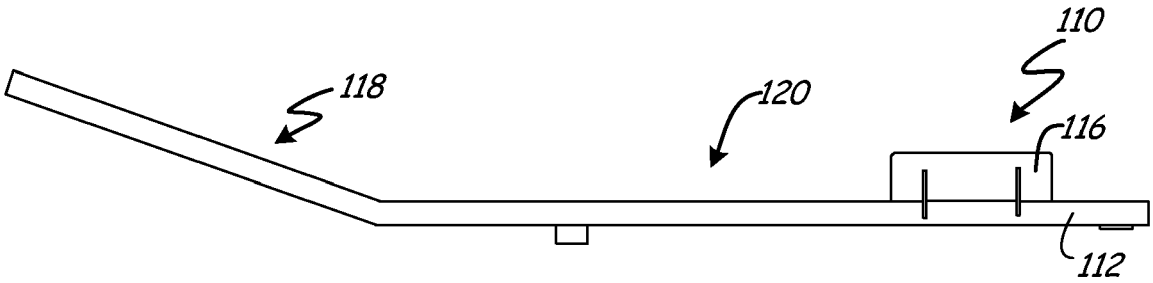
FIG. 8A is a side view of a ball ramp.
Figure 8B:
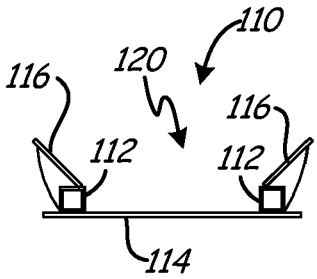
FIG. 8B is an end view of the ball ramp of FIG. 8A.

FIGS. 8A and 8B illustrate one embodiment of a ball ramp 110 that is mounted to the ball return mechanism 34 when assembled. The ball ramp 110 includes runners 112, a plate 114, and flanges or guards 116. The runners 112 include a lower section 118 and an upper section 120.

The hollow frame runners 112 are spaced at a distance from one another and can be angled in the lower section 118 (the lower section 118 of the ball ramp 110 is disposed further away from the orifice 82 when the ball ramp 110 is mounted on the main body 86 of the ball return mechanism 34 (FIG. 4). The plate 114 extends between the upper section 120 of each of the runners 112. When assembled the plate 114 interfaces with body 86 of the ball return mechanism 34 and is caught under (or hooks around) the tabs 88 to mount the ball ramp 110 on the ball return mechanism 34 (FIG. 4). The flanges 116 extend from the upper portion 120 of the runners 112. The flanges (or guards) 116 increase the area of the ball ramp 110 under the orifice 82, thereby increasing the likelihood that shot basketballs will be enter the ball ramp 110 and descend between the runners 112. The lower section 118 of each of the runners 112 are angled to more effectively direct the basketballs back to the shooter from the upper section 120.

Figure 9:
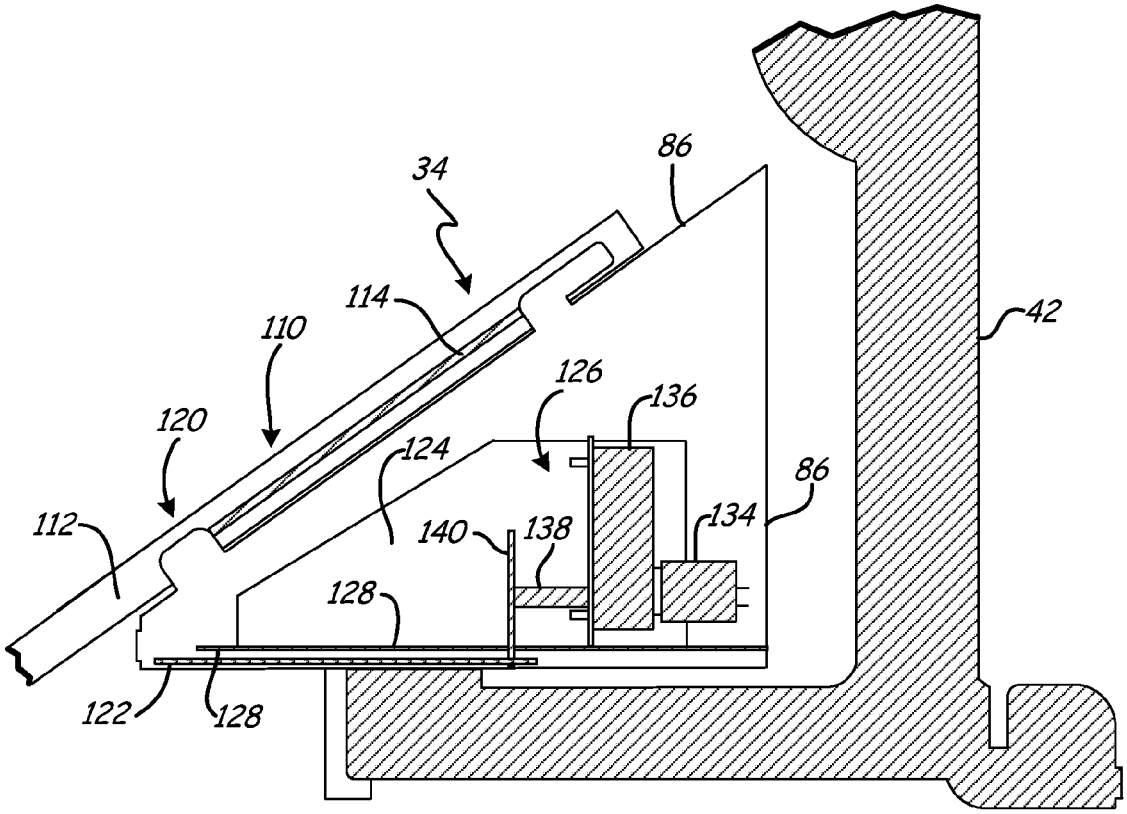
FIG. 9 is a sectional view of the ball return mechanism of FIG. 4.
Figure 9A:
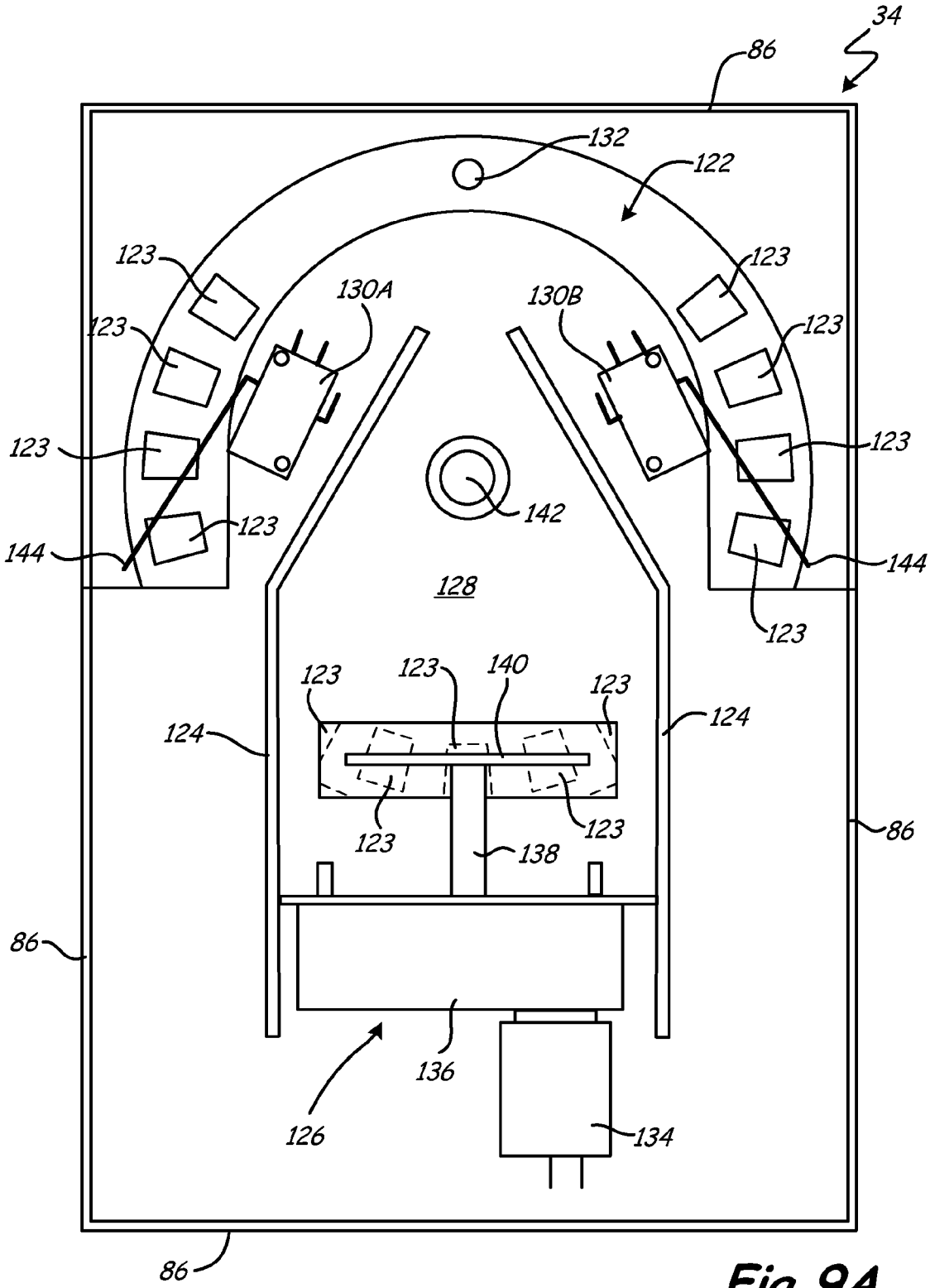
FIG. 9A is a top view of the ball return mechanism of FIG. 9.

FIG. 9 is a sectional view of one embodiment of the ball return mechanism 34. FIG. 9A is a top view of the ball return mechanism with the ball ramp 110 and top surface of the main body 86 removed. In addition to the main body 86, the ball return mechanism 34 includes a stationary sprocket 122. Within the main body 86 the ball return mechanism 34 includes an internal frame 124, a drive assembly 126, a mounting plate 128, and limit switches 130A and 130B. The stationary sprocket 122 includes a bolt 132. The drive assembly 126 includes a motor 134, a gear box 136, a drive shaft 138, and a rotatable sprocket 140. The mounting plate 128 includes a shoulder bolt 142. The limit switches 130 each include an arm 144.

In the embodiment of the ball return mechanism 34 shown, the main body 86 surrounds and protects the drive assembly 126 which is housed therein. The stationary sprocket 122 is disposed on the foot portion 42 of the frame 28 below a lower portion of the main body 86. Within the rotatable main body 86 the internal frame 124 connects to the drive assembly 126 to position the drive assembly 126 above the mounting plate 128. The mounting plate 128 extends below the drive assembly 126 and connects to the main body 86 but does not entirely cover the stationary sprocket 122 (and thus does not entirely enclose the drive assembly 126). The limit switches 130A and 130B are secured to the mounting plate 128 adjacent the an interior edge of the mounting plate 128. The bolt 132 extends upward from the stationary sprocket 122 adjacent the main body 86 and mounting plate 128. The bolt 132 is disposed to be selectively contacted by the limit switches 130A and 130B as the main body 86 and mounting plate 128 rotate relative to the stationary sprocket 122.

The drive assembly 128 has a motor 134 that drives the drive shaft 138 through the gear box 136. The drive shaft 138 connects to the rotatable sprocket 140 which has teeth that mesh with teeth or apertures 123 in the stationary sprocket 122 to rotate the main body 86 and mounting plate 128 relative to the stationary sprocket 122 on the shoulder bolt 142. The arm 144 of each limit switch 130A and 130B projects out over the open area above stationary sprocket 122. When the main body 86 and mounting plate 128 rotate sufficiently in either direction with respect to the stationary sprocket 122, one arm 144 of the corresponding limit switch 130A or 130B contacts the bolt 132 and is depressed thereby. The depression of the arm 144 sends an electronic signal to the motor 134 which reverses the direction of rotation of the main body 86, drive assembly 126, and mounting plate 128 in response.

In this manner or other equivalent manners that would be recognized by one of skill in the art, the main body 86 and mounting plate 128 are reciprocatingly driven from contact with limit switch 130A to contact with the other limit switch 130B. The position of the arm 144 on either switch 130A or 130B can be changed if the user desires to further or limit the rotational travel of the main body 86 and mounting plate 128 in either direction. Changing the amount of rotational travel will change the distribution pattern of returned basketballs to the shooter on the court 16 (FIG. 1A). The ball return mechanism 34 also can be manually rotated by the shooter to return shot basketballs to a particular location on the court 16 (e.g. the baseline or the top of the key).

Although the present invention has been described with reference to preferred embodiments, workers skilled in the art will recognize that changes may be made in form and detail without departing from the spirit and scope of the invention.

The invention claimed is:

1. A basketball return apparatus for collecting and returning basketballs shot at a basketball hoop back to a shooter, the apparatus comprising:

a L-shaped frame having a back portion and a base portion, the back portion having an upper end adapted to mount on a rim support bracket of the basketball hoop and center and stabilize the frame with respect to the basketball hoop, the back portion having side members that connect to the upper end and extend generally vertically downward to connect to the base portion, the base portion defining an orifice through which shot basketballs can descend, wherein when the frame is positioned on the basketball hoop the back portion of the frame is located behind a rim of the basketball hoop, the vertical members are spaced apart from one another on opposite sides of the rim, and the base portion is positioned below and generally aligned with the rim;

a net that is attached to the base portion of the frame to form a funnel shaped enclosure having an open top end and an open end bottom, the open top end having a larger area than the open bottom end, the enclosure directing shot basketballs downward to the base portion and extending to a height above the rim; and a ball return mechanism that is solely supported by and mounted to the frame and extending below the orifice and net, the ball return mechanism having a ramp and being configured to pivot with respect to the frame to direct shot basketballs back to the shooter at variable court locations.

2. The apparatus of claim 1, wherein the ball return mechanism has a motor which rotatably drives the ball return mechanism.

3. The apparatus of claim 1, wherein the upper end of the back portion includes a mounting plate adapted to interface with and seat on the rim support bracket of the rim.

4. The apparatus of claim 3, wherein the mounting plate has mounting pads disposed to either side of the rim support bracket and angled relative one another to contact and interface along the back of the rim when the apparatus is mounted on the support bracket, and wherein the mounting pads reduce forward tilting and lateral swaying of the apparatus.

5. The apparatus of claim 1, further comprising an extendible support arm that connects to the frame, wherein the extendible support arm is adapted to engage a stanchion of the basketball hoop to increase the stability of the apparatus.

6. The apparatus of claim 1, further comprising a drop stand that receives the frame and is selectively attachable and detachable therefrom, wherein the stand allows the apparatus to be mounted on the rim support bracket and dismounted therefrom from a set up position below the rim.

7. The apparatus of claim 1, further comprising arms that are connected to the frame and are retractable and extendable to adjust the height of the net with respect to the rim.

8. The apparatus of claim 7, wherein the net includes a cord which is received in apertures in the base portion of the frame, the cord allows the net to be selectively drawn tighter against the frame and the arms.

9. The apparatus of claim 1, wherein the net is attached to the arms and extends from adjacent the frame to a height of between about 15 to about 21 inches above the rim and extends outward from adjacent the base portion of the frame to a distance of between about 40 to 60 inches from a center point of the rim.

10. The apparatus of claim 1, further comprising a coupling device to assist the frame in mounting on the rim support bracket.

11. A basketball return apparatus for collecting and returning basketballs shot at a basketball hoop back to a shooter, the apparatus comprising:

a L-shaped frame having a back portion and a base portion, the back portion having an upper end adapted to mount on a rim support bracket of the basketball hoop without additional support and center and stabilize the frame with respect to the basketball hoop, the back portion having side members that connect to the upper end and extending generally vertically downward to connect to the base portion, the base portion defining an orifice through which shot basketballs can descend, wherein when the frame is positioned on the basketball hoop the frame is positioned entirely forward of and does not extend around or over the backboard to mount thereon and the back portion of the frame is located behind a rim of the basketball hoop, the vertical members are spaced apart from one another on opposite sides of the rim, and the base portion is positioned below and generally aligned with the rim;

a net that is attached to the base portion of the frame to form a funnel shaped enclosure having an open top end and an open end bottom, the open top end having a larger area than the open bottom end, the enclosure directing shot basketballs downward to the base portion and extending to a height above the rim; and a ball return mechanism solely supported by and mounted to the frame so as to pivot with respect thereto, the ball return mechanism disposed generally below the orifice and net to direct shot basketballs back to the shooter at variable court locations.

12. The apparatus of claim 11, wherein the back portion has a mounting plate adapted to interface with and seat on the rim support bracket of the rim.

13. The apparatus of claim 12, wherein the mounting plate has mounting pads disposed to either side of the rim support bracket and angled relative one another to contact and interface along the back of the rim when the apparatus is mounted on the support bracket, and wherein the mounting pads reduce forward tilting and lateral swaying of the apparatus.

14. The apparatus of claim 11, wherein the ball return mechanism includes a motor which rotatably drives the ball return mechanism reciprocatingly from a first limit to a second limit.

15. The apparatus of claim 11, wherein the ball return mechanism includes a ramp which directs basketballs to the shooter.

16. The apparatus of claim 11, further comprising an extendible support arm that connects to the frame, wherein the extendible support arm is adapted to engage a stanchion of the basketball hoop to increase the stability of the apparatus.

17. The apparatus of claim 11, further comprising a drop stand that receives the frame and is selectively attachable and detachable therefrom, wherein the stand allows the apparatus to be mounted on the rim support bracket and dismounted therefrom from a set up position below the rim.

18. The apparatus of claim 11, further comprising arms that are connected to the frame and are retractable and extendable to adjust the height of the net with respect to the rim.

19. The apparatus of claim 11, further comprising a coupling device to assist the frame in mounting on the rim support bracket.

* * * * *